US008096236B2

(12) United States Patent
Fukami et al.

(10) Patent No.: US 8,096,236 B2
(45) Date of Patent: Jan. 17, 2012

(54) PRESS MACHINE

(75) Inventors: Yasuhiko Fukami, Inuyama (JP); Kiyoshi Yamane, Inuyama (JP)

(73) Assignee: Murata Machinery, Ltd., Kyoto-shi (JP)

( * ) Notice: Subject to any disclaimer, the term of this patent is extended or adjusted under 35 U.S.C. 154(b) by 107 days.

(21) Appl. No.: 12/616,979

(22) Filed: Nov. 12, 2009

(65) Prior Publication Data

US 2010/0126361 A1 May 27, 2010

(30) Foreign Application Priority Data

Nov. 21, 2008 (JP) ..... 2008-297875
Jan. 9, 2009 (JP) ..... 2009-003322

(51) Int. Cl.
*B30B 15/28* (2006.01)
*B30B 15/00* (2006.01)

(52) U.S. Cl. ..... 100/99; 100/43; 100/231

(58) Field of Classification Search ..... 100/43, 100/50, 99, 231, 258 A; 72/21.4, 455
See application file for complete search history.

(56) References Cited

U.S. PATENT DOCUMENTS 3,561,252 A * 2/1971 Norton et al. ..... 72/455
5,813,263 A * 9/1998 Tokai ..... 72/21.4
6,068,463 A * 5/2000 Urbanek ..... 425/169

FOREIGN PATENT DOCUMENTS

JP 8-019900 A 1/1996
JP 11-123475 A 5/1999

* cited by examiner

*Primary Examiner* — Jimmy T Nguyen
(74) *Attorney, Agent, or Firm* — Westerman, Hattori, Daniels & Adrian, LLP

(57) ABSTRACT

A press machine is provided that can accurately detect load acted on a frame. A frame 1 includes an upper horizontal frame 1*b*, a lower horizontal frame 1*a*, and a vertical frame 1*c* arranged to connect the upper horizontal frame 1*b* and the lower horizontal frame 1*a*. A press drive mechanism 8 is provided to the upper horizontal frame 1*b*. A strain generation member 23 is arranged across from the upper horizontal frame 1*b* to the vertical frame 1*c*. In the strain generation member 23, an intermediate portion 23*a* has a cross-sectional area that is smaller than those of end portions 23*b*, 23*c* fixed to the upper horizontal frame 1*b* and the vertical frame 1*c*, respectively. A strain amount detecting body 24 is attached to the intermediate portion 23*a* of the strain generation member 23 in order to detect a strain amount.

4 Claims, 8 Drawing Sheets

PRESS MACHINE

BACKGROUND OF THE INVENTION

1. Field of the Invention

The present invention relates to a press machine such as a punch press or the like that can detect load acted on a frame.

2. Description of the Related Art

When a punch press performs press working, load is imposed on a frame of the punch press. When overload exceeding an allowable limit of the frame is imposed, each portion of the machine including the frame maybe damaged. When performing punch working, which is defined as press working, load required for such punch working can be estimated from the thickness of a work and from the size of a portion to be punched, however, when performing forming, it is difficult to estimate load required for such forming, and overload may be applied.

In order to prevent a machine abnormality resulted from overload, Patent Document 1 suggests to provide a drive transmission system arranged between a drive source and a punch tool of a press driving device with load detecting means such as a strain gauge or the like, and thus to output an abnormality signal when a detection value of the load detecting means exceeds a prescribed set value.

[Patent Document 1] Japanese Unexamined Patent Application Publication No. H8-19900

However, the aim of providing the drive transmission system with the load detecting means is not to measure the load actually acted on the frame. Accordingly, the load acted on the frame may not be detected precisely. Further, since the position of the load detecting means moves at the time of press working, it may be difficult to install wiring for acquiring the output of the load detecting means.

SUMMARY OF THE INVENTION

It is an object of the present invention to provide a press machine which can precisely detect load acted on a frame and in which such a load detecting system can be easily installed.

It is another object of the present invention to simplify the load detecting system.

It is yet another object of the present invention to predict an abnormality when overload is imposed on the frame.

According to one aspect of the present invention, a press machine includes a frame having an upper horizontal frame, a lower horizontal frame, and a vertical frame arranged to connect the upper horizontal frame and the lower horizontal frame; a press drive mechanism provided to the upper horizontal frame; an elongate member arranged across from the upper horizontal frame to the vertical frame and fixed at both end portions; and a strain amount detecting body arranged to detect a strain amount of an intermediate portion disposed between the both end portions of the elongate member fixed to the upper horizontal frame and the vertical frame.

When the press drive mechanism performs a pressing operation, load is applied in the vertical direction to the upper horizontal frame, and the upper horizontal frame is deformed in the vertical direction with a connection portion as a fulcrum, where the upper horizontal frame is connected with the vertical frame. Thus, the elongate member arranged across from the upper horizontal frame to the vertical frame expands and/or contracts. An amount of such expansion/contraction of the elongate member varies depending on an amount of the load acted on the frame. Accordingly, by detecting the strain amount of the elongate member by the strain amount detecting body, the amount of the load acted on the frame can be determined. Thus, when compared with detection from load of a drive transmission system or the like, the load actually acted on the frame is measured in the present invention, and accordingly, such load can be accurately detected.

The elongate member and the strain amount detecting body are provided to the stationary frame, and therefore, the load detecting system can be easily installed. Moreover, the connection portion of the upper horizontal frame and the vertical frame, where the elongate member is provided, is disposed away from the press drive mechanism in the horizontal direction and above a table on which a work is placed, and therefore, the elongate member can be provided without disrupting the pressing operation of the press drive mechanism and work feeding. Further, among portions where the pressing operation and the work feeding are not disrupted, the connection portion of the upper horizontal frame and the vertical frame is the most likely portion where the upper horizontal frame and the vertical frame tend to deform when the pressing load is applied. Accordingly, by arranging the elongate member across from the upper horizontal frame to the vertical frame, the load acted on the frame can be reliably and accurately detected.

According to another aspect of the present invention, the elongate member may be a strain generation member including, at the intermediate portion, a narrowed portion having a cross-sectional area that is smaller than those of the both end portions. By providing the strain generation member with the above-described shape as the elongate member, a great amount of strain appears at the narrowed portion. Accordingly, by detecting the strain amount of the narrowed portion by the strain amount detecting body, the load acted on the frame can be further accurately detected.

According to yet another aspect of the present invention, in the case where the upper horizontal frame and the vertical frame of the frame have a laterally-facing plane portion, the elongate member may be a plate member and fixed such that the both end portions thereof are laterally contacted to the plane portion of the upper horizontal frame and the vertical frame. Such a plate member, which is provided as the elongate member, can be easily manufactured, and can be easily fixed to the plane portion of the upper horizontal frame and the vertical frame.

According to yet another aspect of the present invention, abnormality determining means is preferably provided that compares a detection value of the strain amount detecting body with a prescribed set value and outputs an abnormality signal when such a detection value exceeds the set value.

By providing the abnormality determining means, an abnormality can be predicted when overload is applied, and each portion of the machine can be prevented from being damaged.

According to yet another aspect of the present invention, a press machine includes a frame having an upper horizontal frame, a lower horizontal frame, and a vertical frame arranged to connect the upper horizontal frame and the lower horizontal frame; a press drive mechanism provided to the upper horizontal frame; an elongate member arranged across from the upper horizontal frame to the vertical frame and fixed at both end portions; and a strain amount detecting body arranged to detect a strain amount of an intermediate portion disposed between the both end portions of the elongate member fixed to the upper horizontal frame and the vertical frame. Accordingly, the load acted on the frame can be precisely detected, and also, such a load detecting system can be easily installed.

Where the elongate member is a strain generation member including, at the intermediate portion, a narrowed portion having a cross-sectional area that is smaller than those of the both end portions, the load acted on the frame can be further accurately detected.

Where the upper horizontal frame and the vertical frame of the frame include the laterally-facing plane portion, and where the elongate member is the plate member and fixed such that the end portions are laterally contacted to the plane portion of the upper horizontal frame and the vertical frame, a mechanism for detecting the load acted on the frame can be simplified.

Where the abnormality determining means is provided that compares the detection value of the strain amount detecting body with the prescribed set value and outputs the abnormality signal when such a detection value exceeds the set value, an abnormality can be predicted when overload is applied to the frame.

DETAILED DESCRIPTION OF PREFERRED EMBODIMENTS

Figure 1A:
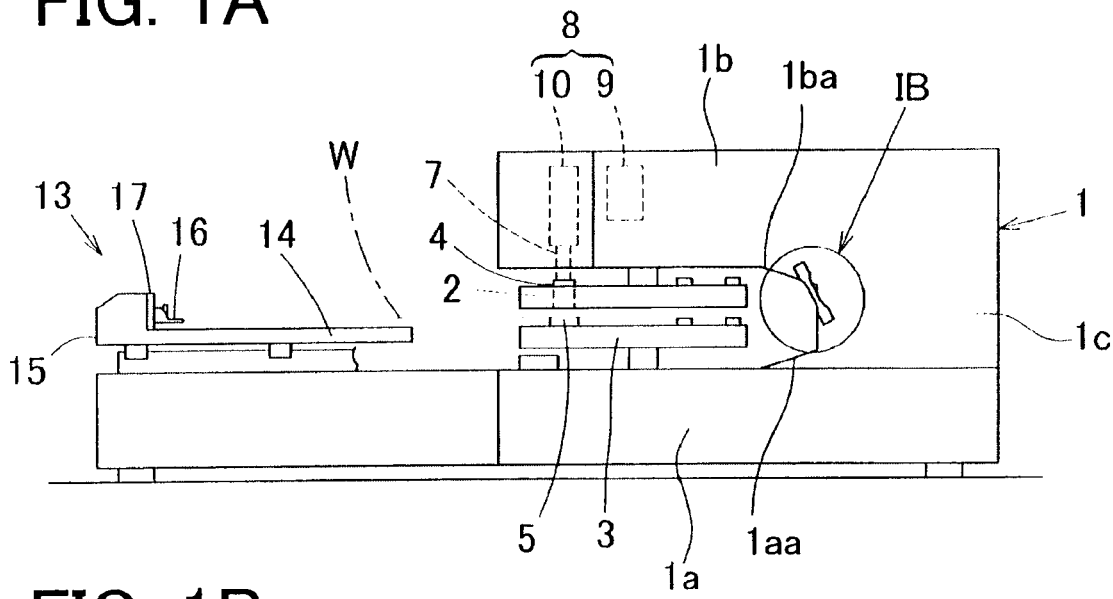
FIG. 1(A) is a side view of a press machine according to a first embodiment of the present invention.
Figure 2:
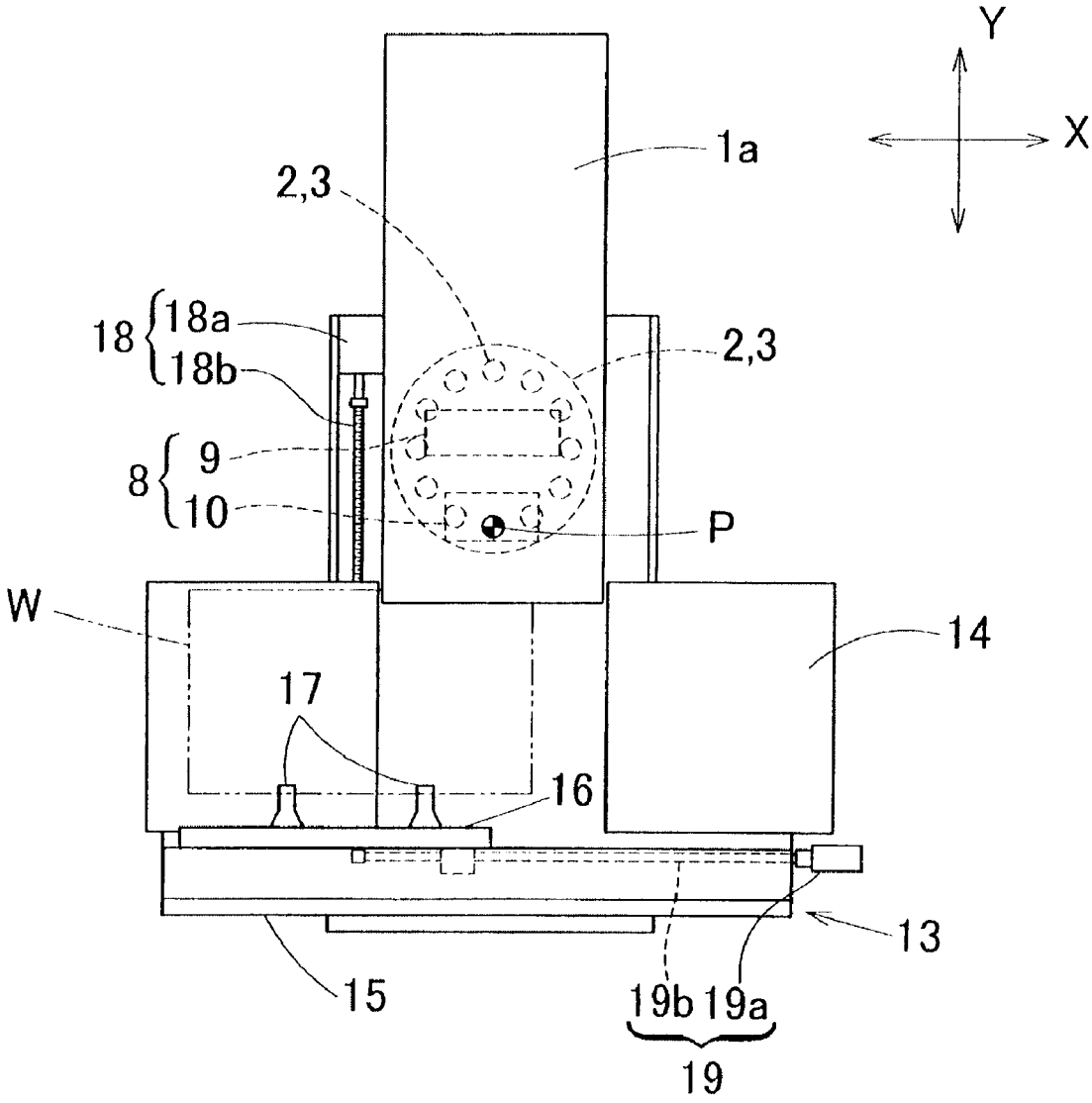
FIG. 2 is a plan view of the press machine.
Figure 3:
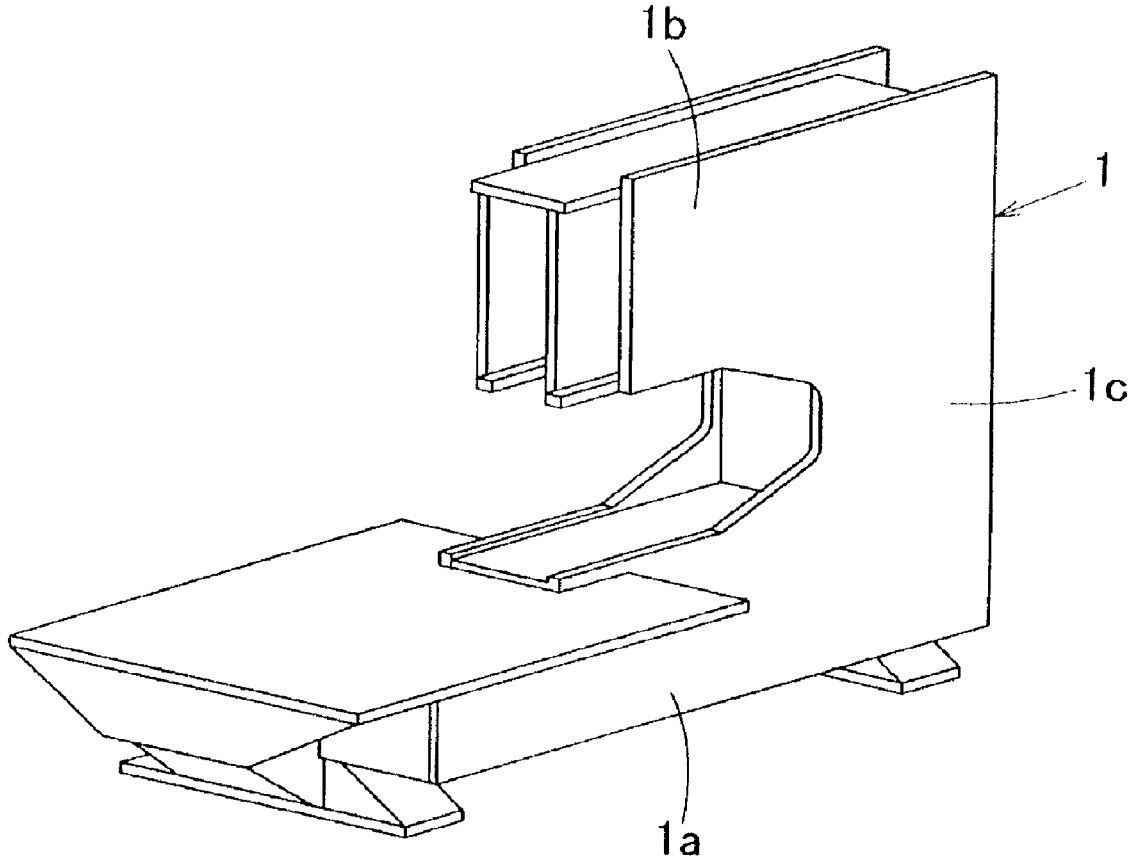
FIG. 3 is a perspective view of a frame of the press machine.

A first embodiment of the present invention will be described with reference to the drawings. A press machine according to the present embodiment is a punch press. FIG. 1(A) is an entire side view, FIG. 2 is an entire plan view, and FIG. 3 is a perspective view of a frame. The punch press includes a frame 1 having a C shape in side view. More specifically, the frame 1 includes a lower horizontal frame 1*a* extending horizontally along the floor, an upper horizontal frame 1*b* that is arranged above the lower horizontal frame 1*a* and extends in the same direction as the lower horizontal frame 1*a*, and a vertical frame 1*c* arranged to vertically connect one end of the lower horizontal frame 1*a* and one end of the upper horizontal frame 1*b*. The upper horizontal frame 1*b* is in a cantilever state, and space is provided below the upper horizontal frame 1*b*, where later-described turrets 2 and 3 are arranged. A lower portion on a base side of the upper horizontal frame 1*b* includes a slanted portion 1*ba* where a lower end lowers towards the vertical frame 1*c*. An upper portion on a base side of the lower horizontal frame 1*a* includes a slanted portion 1*aa* where an upper end rises towards the vertical frame 1*c*. Each of the upper horizontal frame 1*b* and the vertical frame 1*c* has a rectangular shape in cross section and has a plane surface on each side.

The upper horizontal frame 1*b* and the lower horizontal frame 1*a* of the frame 1 respectively support the upper turret 2 and the lower turret 3, which are an upper tool supporting body and a lower tool supporting body, such that the turrets 2 and 3 can rotate around a coaxial vertical axis. A plurality of punch tools 4 and a plurality of die tools 5 are aligned in a peripheral direction on the turrets 2 and 3, respectively. The upper and lower turrets 2 and 3 are rotated in synchronization with each other by a motor (not illustrated) and indexed at a punching position P.

Indexed at the punching position P, the punch tool 4 is driven to be elevated and lowered by a ram 7. The ram 7 is driven to be elevated and lowered by a press drive mechanism 8 provided to the upper horizontal frame 1*b*. The press drive mechanism 8 is formed of, for example, a servomotor 9 and a movement converting mechanism 10 that converts the rotation of the servomotor 9 into linear movement.

A plate material W is fed back and forth from side to side on a table 14 by plate material feeding means 13 so that a portion to be processed is indexed at the punching position P. In the plate material feeding means 13, a carriage 15 arranged to move back and forth (in a Y direction) is provided with a cross slide 16 arranged to move laterally (in an X direction), and a work holder 17 arranged to grip and hold an end of the plate material W is attached to the cross slide 16. A back-and-forth movement mechanism 18 arranged to move the carriage 15 back and forth is formed of, for example, a servomotor 18*a* and a conversion mechanism 18*b* such as a ball screw or the like arranged to convert the rotation of the servomotor 18*a* into linear movement. A lateral movement mechanism 19 arranged to move the cross slide 16 laterally is formed of, for example, a servomotor 19*a* and a conversion mechanism 19*b* such as a ball screw or the like arranged to convert the rotation of the servomotor 19*a* into linear movement.

Figure 1B:
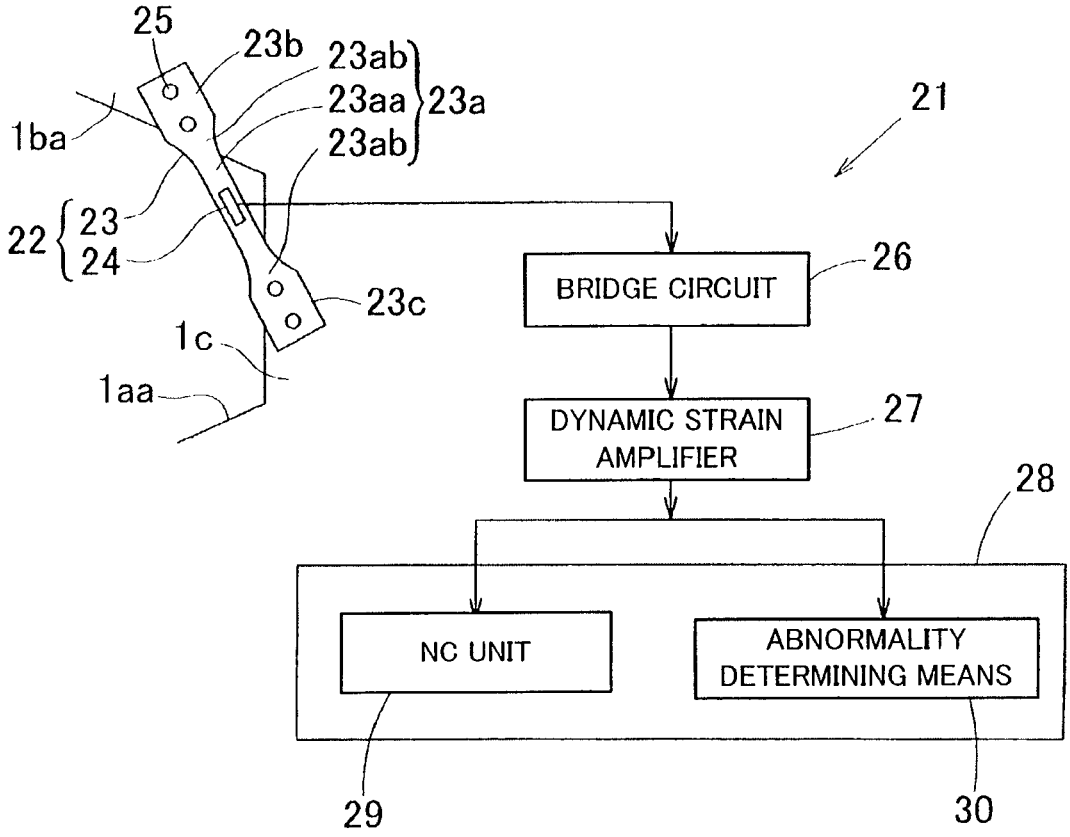
FIG. 1(B) is an enlarged view of an IB portion of the press machine, accompanied with a block diagram of a load detecting system.

As illustrated in FIG. 1(B), the punch press includes a load detecting system 21 arranged to detect load acted on the frame 1. The load detecting system 21 includes a strain amount detecting unit 22 illustrated in FIG. 4. The strain amount detecting unit 22 includes a strain generation member 23, which is an elongate member arranged across from the upper horizontal frame 1*b* to the vertical frame 1*c* obliquely to the vertical direction, and a strain amount detecting body 24 such as a strain gauge or the like arranged to detect a strain amount of the strain generation member 23.

The strain generation member 23 is a plate member made of metal such as a steel plate etc., and includes a narrowed portion 23*aa* at an intermediate portion 23*a*. The narrowed portion 23*aa* has a width that is narrower than those of both end portions 23*b* and 23*c*. In the example of the drawing, the narrowed portion 23*aa* has a rectangular shape of a prescribed width, and since the narrowed portion 23*aa* has a narrow width, a cross-sectional shape thereof is smaller than those of both end portions 23*b* and 23*c*. The intermediate portion 23*a* includes the narrowed portion 23*aa* and cross-section changed portions 23*ab* on both ends, where the width gradually narrows from the corresponding end portion 23*b* or 23*c*. The strain generation member 23 is fixed by bolts 25 or the like such that the end portions 23*b* and 23*c* are laterally contacted to the side surface of the upper horizontal frame 1*b* and the vertical frame 1*c*. More specifically, the strain generation member 23 is arranged across from the slanted portion 1*ba* of the upper horizontal frame 1*b* to the vicinity of a front end at the vertical center of the vertical frame 1*c*. That is, the strain generation member 23 is disposed in the vicinity of a connection portion of the upper horizontal frame 1*b* and the vertical frame 1*c*.

The strain amount detecting body 24 is attached to the intermediate portion 23*a* of the strain generation member 23 using glue or the like. In the present embodiment, the strain amount detecting body 24 is attached on each surface of the strain generation member 23. That is, two strain amount detecting bodies 24 are provided in the present embodiment.

Figure 5:
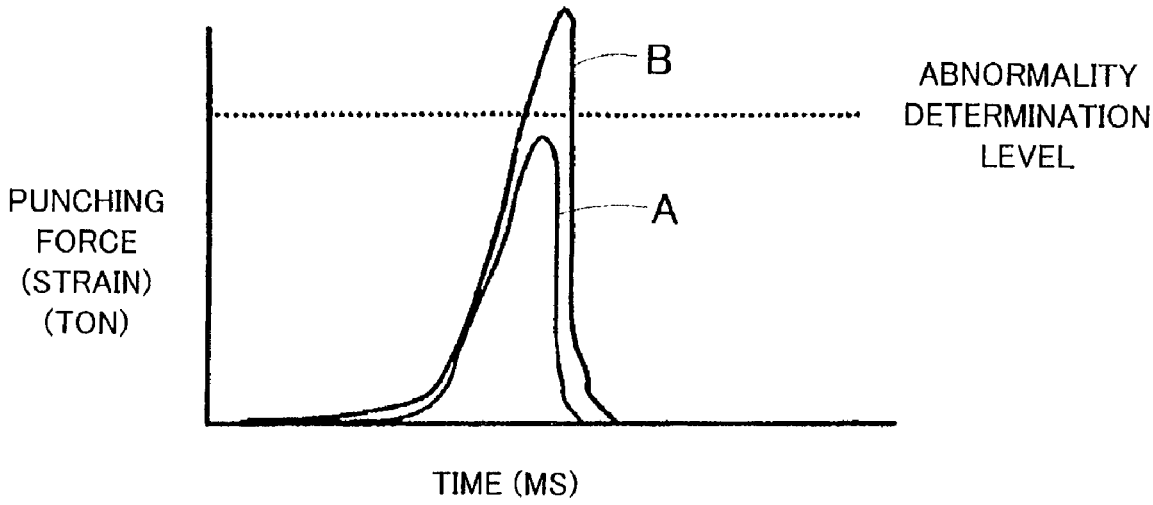
FIG. 5 is a graph representing an example of waveforms of calibration detection values.

When load is applied to the frame 1, strain is generated at the strain generation member 23. The strain is converted into an electric signal by the strain amount detecting bodies 24, abridge circuit 26, and a dynamic strain amplifier 27. The electric signal may be either a current signal or a voltage signal. The electric signal is calibrated based on well-known punching working. FIG. 5 illustrates the electric signal of the punching working, that is, waveforms of a punching force. The electric signal of the punching working is transmitted to a Numerical Control unit (NC unit) 29 and abnormality determining means 30 of a control panel 28.

The NC unit 29 controls the entire machine. The abnormality determining means 30 compares a detection value, which is the punching force, with a set value defined as an abnormality determination level, and when the detection value exceeds the set value, the abnormality determining means 30 outputs an abnormality signal. In FIG. 5, for example, in the case of line A, a maximum detection value falls below the set value, and accordingly, the abnormality signal is not output. In the case of line B, a maximum detection value exceeds the set value, and accordingly, the abnormality signal is output. When the abnormality signal is output, an alarm is given through a lamp or a buzzer etc., or an urgent stop command is output to the NC unit 29.

An operation of the above configuration will now be described. When the press drive mechanism 8 performs a pressing operation, load is applied in the vertical direction to the upper horizontal frame 1*b*, and the upper horizontal frame 1*b* is deformed in the vertical direction with the connection portion as a fulcrum, where the upper horizontal frame 1*b* and the vertical frame 1*c* are connected. Thus, the strain generation member 23 arranged across from the upper horizontal frame 1*b* to the vertical frame 1*c* expands and/or contracts. The amount of the expansion/contraction of the strain generation member 23 varies depending on the amount of the load acted on the frame 1. By detecting the strain amount of the strain generation member 23 by the strain amount detecting bodies 24, the amount of the load acted on the frame 1 can be determined. By providing the narrowed portion 23*aa* having a cross-sectional area reduced in size by narrowing the width of the intermediate portion 23*a* of the strain generation member 23, a great amount of strain appears at the narrowed portion 23*aa*. Since the strain amount of the narrowed portion 23*aa* is detected by the strain amount detecting bodies 24, a high accuracy of the strain amount detection can be achieved, and the load can be precisely acquired.

When it is determined by the abnormality determining means 30 that the acquired load exceeds the set value, the abnormality signal is output, and the alarm is given or the urgent stop command is output to the NC unit 29. Thus, machine damage can be prevented by stopping the operation of the punch press. Further, acquired load data is stored in the NC unit 29 along with processing conditions of the time and accumulated as a database. By using the database, processing know-how can be improved.

Since the strain generation member 23 is formed of a plate member, it can be easily manufactured. Moreover, since both end portions 23*b* and 23*c* of the strain generation member 23 are laterally contacted to the plane side surface of the upper horizontal frame 1*b* and the vertical frame 1*c*, the strain generation member 23 can be easily fixed to the upper horizontal frame 1*b* and the vertical frame 1*c*. The connection portion of the upper horizontal frame 1*b* and the vertical frame 1*c*, where the strain generation member 23 is provided, is disposed away from the press drive mechanism 8 in the horizontal direction and above the table 14. Therefore, the strain generation member 23 can be arranged without disrupting the pressing operation of the press drive mechanism 8 and the work feeding. Among portions where the pressing operation and the work feeding are not disrupted, the connection portion of the upper horizontal frame 1*b* and the vertical frame 1*c* is the most likely portion where the upper horizontal frame 1*b* and the vertical frame 1*c* tend to deform when the pressing load is applied. Therefore, by arranging the strain generation member 23 across from the upper horizontal frame 1*b* to the vertical frame 1*c*, the load acted on the frame 1 can be reliably and accurately detected.

Figure 4A:
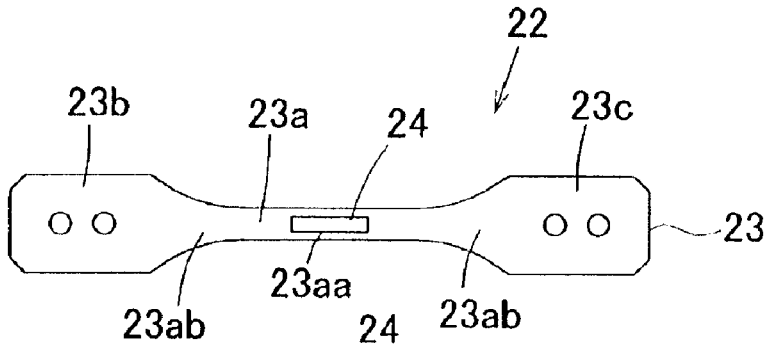
FIG. 4(A) is a front view of a strain amount detecting unit of the load detecting system.
Figure 4B:
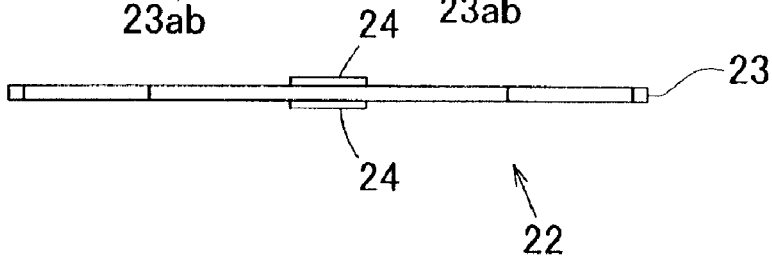
FIG. 4(B) is a base view of the strain amount detecting unit.
Figure 6A:
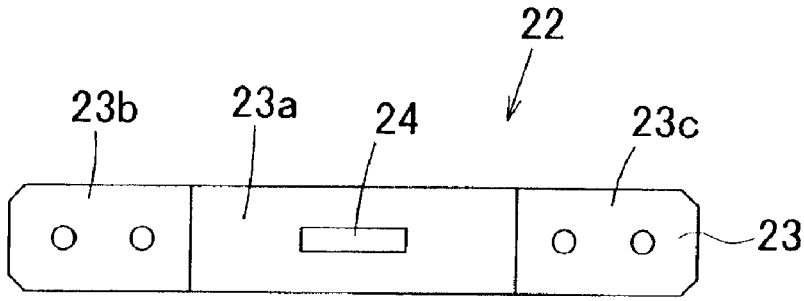
FIG. 6(A) is a front view of another strain amount detecting unit.
Figure 6B:
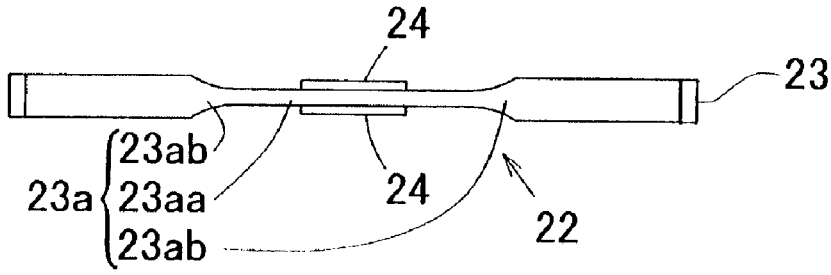
FIG. 6(B) is abase view of the other strain amount detecting unit.

In the strain amount detecting unit 22 of FIG. 4, the width of the intermediate portion 23*a* of the strain generation member 23 is narrowed, however, the shape of the strain generation member 23 may be changed as the strain amount detecting unit 22 of FIG. 6, that is, the width of the strain generation member 23 may be constant, the intermediate portion 23*a* may include the thin narrowed portion 23*aa*, and the strain amount detecting body 24 may be attached to the thin narrowed portion 23*aa*. In the example of the drawing, the narrowed portion 23*aa* has a rectangular shape of constant thickness, and by reducing the thickness, the cross-sectional shape of the narrowed portion 23*aa* is smaller than those of the end portions 23*b* and 23*c*. The intermediate portion 23*a* includes the narrowed portion 23*aa* and cross-section changed portions 23*ab* on both ends, where the width gradually narrows from the corresponding end portion 23*b* or 23*c*. In this case, when compared with other portions, the intermediate portion 23*a* also has a smaller cross-sectional area. Accordingly, the strain of the strain generation member 23 can be accurately detected by the strain amount detecting bodies 24.

Figure 7A:
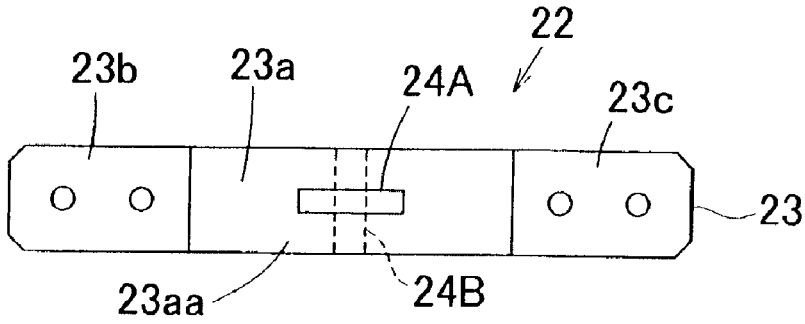
FIG. 7(A) is a front view of yet another strain amount detecting unit.
Figure 7B:
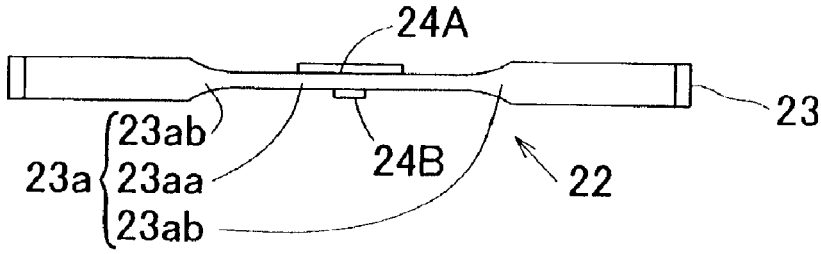
FIG. 7(B) is abase view of the other strain amount detecting unit.

In both the strain amount detecting units 22 of FIGS. 4 and 6, the strain amount detecting bodies 24 on both sides of the strain generation member 23 detect the expansion and contraction in the longitudinal direction of the strain generation member 23, however, as illustrated in FIG. 7, strain amount detecting bodies 24A and 24B may be attached on both sides in the shape of a cross so that the strain amount detecting body 24A detects expansion and contraction in the longitudinal direction of the strain generation member 23 and the other strain amount detecting body 24B detects expansion and contraction in the width direction of the strain generation member 23.

According to another embodiment (not illustrated), the strain generation member 23 may be attached on each side (on right and left sides) of the frame 1, and the strain amount detecting bodies 24 may be connected to the bridge circuit 26 to acquire the electric signal. In such a case, a subtle load difference between the right and left sides of the frame 1 is averaged, which thereby can further improve the accuracy.

Figure 8:
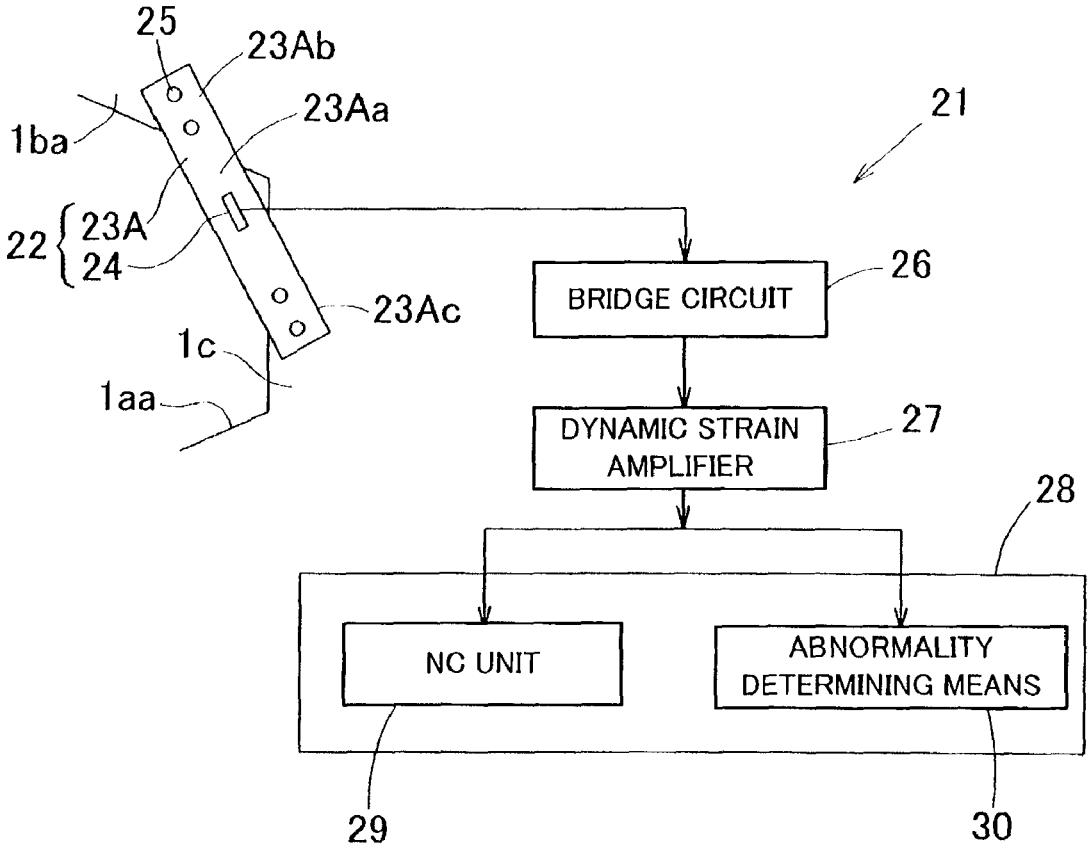
FIG. 8 is a partial side view of a press machine according to another embodiment of the present invention, accompanied with a block diagram of a load detecting system.

In the above embodiment, as the strain generation member 23, the elongate member is used including, at the intermediate portion, the narrowed portion 23*aa* having the cross-sectional area that is smaller than those of the end portions, however, the narrowed portion 23*aa* may not be necessarily provided. For example, in place of the strain generation member 23, an elongate member 23A formed of a simple rectangular plate illustrated in FIG. 8 maybe provided. Similarly to the example of FIG. 1, the elongate member 23A is fixed via the bolts 25 or the like such that the strain amount detecting body 24 is attached to an intermediate portion 23A*a*, and that both end portions 23A*b* and 23A*c* are laterally contacted to the side surface of the upper horizontal frame 1*b* and the vertical frame 1*c*. When using the elongate member 23A of this shape, unlike the example of FIG. 1, the strain cannot be increased by the narrowed portion 23*aa*, however, the strain amount of the frame 1 can also be detected in good condition. The other configurations and advantages of the embodiment of FIG. 8 are similar to those of the first embodiment of FIG. 1.

In each of the above-described embodiments, the punch press is used as the press machine, however, the present invention may be applied to press machines other than the punch press, such as, for example, conventional forming machines or the like.

1 Frame
1*a* Lower horizontal frame
1*b* Upper horizontal frame
1*c* Vertical frame
8 Press drive mechanism
21 Load detecting system
22 Strain amount detecting unit
23 Strain generation member (elongate member)
23*a* Intermediate portion
23*aa* Narrowed portion
23*b*, 23*c* End portions
23A Elongate member
24, 24A, 24B Strain amount detecting bodies
29 NC unit
30 Abnormality determining means

What is claimed is:

1. A press machine comprising:

a frame including an upper horizontal frame, a lower horizontal frame, and a vertical frame arranged to connect the upper horizontal frame and the lower horizontal frame;

a press drive mechanism provided to the upper horizontal frame;

an elongate member having a first end portion fixed to the upper horizontal frame and a second end portion fixed to the vertical frame; and a strain amount detecting body arranged to detect a strain amount at an intermediate portion disposed between the first and second end portions of the elongate member fixed to the upper horizontal frame and the vertical frame.

2. The press machine according to claim 1, wherein the elongate member is a strain generation member including, at the intermediate portion, a narrowed portion having a cross-sectional area that is smaller than a cross-sectional area of the end portion.

3. The press machine according to claim 1, wherein the upper horizontal frame and the vertical frame of the frame include a laterally-facing plane portion, and the elongate member is a plate member and fixed such that the first and second end portions are laterally contacted with the plane portion of the upper horizontal frame and the vertical frame, respectively.

4. The press machine according to any one of claims 1 to 3, comprising abnormality determining means arranged to compare a detection value of the strain amount detecting body with a prescribed set value and to output an abnormality signal when the detection value exceeds the set value.

* * * * *